US011318582B2

(12) United States Patent
Schnideritsch et al.

(10) Patent No.: US 11,318,582 B2
(45) Date of Patent: May 3, 2022

(54) POSITIONING GUIDE DEVICE

(71) Applicant: MAGNA Metalforming GmbH, Vienna (AT)

(72) Inventors: Thorsten Schnideritsch, Gleisdorf (AT); Daniel Stelzer, Stainz (AT)

(73) Assignee: MAGNA METALFORMING GMBH, Vienna (AT)

( * ) Notice: Subject to any disclaimer, the term of this patent is extended or adjusted under 35 U.S.C. 154(b) by 0 days.

(21) Appl. No.: 16/951,089

(22) Filed: Nov. 18, 2020

(65) Prior Publication Data

US 2021/0146504 A1 May 20, 2021

(30) Foreign Application Priority Data

Nov. 20, 2019 (DE) ..... 10 2019 217 918.5

(51) Int. Cl.
*B25B 5/06* (2006.01)

(52) U.S. Cl.
CPC ..... *B25B 5/06* (2013.01)

(58) Field of Classification Search
CPC ..... B25B 5/06; B25B 5/02; B25B 1/02
USPC ..... 269/254 R
See application file for complete search history.

(56) References Cited

FOREIGN PATENT DOCUMENTS

| | | | | | |
|---|---|---|---|---|---|
| CN | 203853468 | U | * | 10/2014 | |
| CN | 203853468 | U | | 10/2014 | |
| CN | 109290429 | A | * | 2/2019 | |
| DE | 3806436 | A1 | | 9/1989 | |
| DE | 10252150 | A1 | | 5/2004 | |
| DE | 102007013513 | B3 | | 8/2008 | |
| DE | 102011102519 | A1 | * | 11/2012 | ..... B21D 22/022 |
| DE | 102011102519 | A1 | | 11/2012 | |
| DE | 202014004486 | U1 | | 8/2014 | |
| DE | 102015205468 | A1 | | 9/2016 | |
| DE | 102018125035 | A1 | | 4/2020 | |
| FR | 2986448 | A1 | | 8/2013 | |
| FR | 2986448 | A1 | * | 8/2013 | ..... B21D 43/003 |
| JP | S62159235 | U | | 10/1987 | |
| JP | 2011110557 | A | | 6/2011 | |
| JP | 2019089089 | A | | 6/2019 | |
| JP | 2019089089 | A | * | 6/2019 | ..... B21D 43/18 |
| WO | 2016150617 | A1 | | 9/2016 | |

* cited by examiner

*Primary Examiner* — Lee D Wilson
*Assistant Examiner* — Jonathan G Santiago Martinez
(74) *Attorney, Agent, or Firm* — Dickinson Wright PLLC

(57) ABSTRACT

A positioning guide device for positioning a blank in a forming die. The positioning guide device includes a positioning guide having a sloped positioning face designed to allow a peripheral edge of the blank to be positioned in a transverse direction by contact with the positioning face. The positioning guide device further comprises a housing module, the positioning guide being mounted in the housing module so as to be linearly displaceable in the transverse direction. The housing module having a spring system for preloading the positioning guide in the transverse direction.

13 Claims, 5 Drawing Sheets

POSITIONING GUIDE DEVICE

CROSS-REFERENCE TO RELATED APPLICATION

This application claims priority to German Patent Application No. DE 10 2019 217 918.5, filed Nov. 20, 2019. The entire disclosure of the above application is incorporated herein by reference.

FIELD OF THE INVENTION

The present invention relates to a positioning guide device for positioning blanks for a forming die.

BACKGROUND OF THE INVENTION

This section provides information related to the present disclosure which is not necessarily prior art Positioning guide devices, for positioning of blanks, are used mainly in the automotive industry, in particular for the production of vehicle body components. For the production of vehicle body components, blanks, i.e. flat metallic components, or metal sheets, are formed into the desired three-dimensional shape in a forming die, in particular in a deep-drawing die. In particular, for precise insertion of the blanks into a forming die, so-called "positioning guides" are used, which are usually columns aligned substantially vertically upwards, each of which has an inclined positioning face, such that a blank delivered to the die from above slides on its peripheral edge, along the positioning face, into the desired position and is lowered into the forming die. For this purpose, frequently, a plurality of positioning guides, distributed around the circumference of the forming die, are used.

For example, known from WO 2016/150617 is a forming die that has a plurality of adjustable positioning guides.

A conventional device for the positioning of blanks, or pressed parts, consists of a positioning guide that is rigidly connected to the die and that may possibly also have a rocker. However, due to production-related fluctuations in the width of so-called "coils", from which the blanks are obtained substantially by trimming, or due to the coils not running in centrally, some blanks assume an inadequate, or incorrect, position in the drawing die. In connection with welded blanks, in particular, the tolerances increase by the number of welded blanks, which results in even greater deviations. As a consequence of the incorrect positioning, various component defects, such as drawing cracks etc., can occur, as well as further surface impairments due to the resulting abrasion and chip formation. Moreover, these deviations must be corrected manually, resulting in production downtimes. In extreme cases, there is the possibility of overlaps, or torn-out metal-sheet parts, which damages the die. In the subsequent production process, further irregularities in respect of the surface, trimmings and flanges can occur as a result of the incorrect positioning of the blank in the drawing die.

The present invention is intended to greatly reduce, or eliminate, the reworking and scrap costs caused by this circumstance, losses due to downtimes and repair times, as well as storage costs incurred and, in particular, costs for external claims.

SUMMARY OF THE INVENTION

This section provides a general summary of the disclosure, and is not a comprehensive disclosure of its full scope or all of its features It is an object of the invention to provide a positioning guide device, for positioning blanks for a forming die, which reduces the problems mentioned above and, in particular, allows the positioning of previously badly positioned blanks, without causing component defects or damage to a die. A further object of the invention is to specify a forming die having at least one such positioning guide device that reduces component defects.

The object is achieved by a positioning guide device for positioning blanks for a forming die, comprising a positioning guide having a sloped positioning face, the positioning face being designed to allow a peripheral edge of a blank to be positioned in a transverse direction by contact with the positioning face, the positioning guide device comprising a housing module, the positioning guide being mounted in the housing module so as to be linearly displaceable in the transverse direction, the housing module having a spring system, the spring system preloading the positioning guide in the transverse direction.

According to the invention, a positioning guide device is not designed as a simple rigid component, but comprises two parts that can be moved linearly relative to each other: on the one hand, the positioning guide in the narrower sense, on which the required positioning slope is realized, and on the other hand a housing module, which is usually rigidly mounted on a forming die. The positioning guide itself is mounted in a displaceable manner in the housing module, a spring system preloading the positioning guide in one direction, the "transverse direction". This transverse direction is the direction in which a blank is usually moved by the positioning face upon lowering of the blank. The positioning face is a face that is usually sloped from the top (thin) to the bottom (thicker) when in the installed position.

According to the invention, a positioning guide can thus yield or recede when a blank impinges on the positioning face of the positioning guide with comparatively greater force, such that hard impacts caused by faulty or incorrectly pre-positioned blanks can be avoided, thus avoiding component and die defects. Following forming with the aid of such positioning guide devices, defective parts can also be identified and rejected at an early stage.

The present invention thus makes it possible to greatly reduce, or eliminate, reworking and scrap costs, losses due to downtimes and repair times, as well as storage costs incurred and, in particular, costs for external claims.

Developments of the invention are specified in the dependent claims, the description and the appended drawings.

Preferably, the spring system comprises a plunger aligned in the transverse direction, the plunger bearing against or being fastened to the positioning guide, the plunger being subjected to a predefined force in the transverse direction in order to preload the positioning guide in the transverse direction, such that, when a blank bears against the positioning guide with a force greater than the predefined force, the plunger is moved linearly against the transverse direction.

The spring system may comprise, in particular, a sprung pressure piece. The spring system of one embodiment therefore comprises a mechanical spring.

The spring system may comprise a pneumatically operated cylinder. The spring system may therefore be pneumatic, and use a gas pressure to apply the preload, or restoring force.

Preferably, the positioning guide comprises a positioning guide bracket and a receiving plate, the positioning guide bracket having the positioning face, the receiving plate being designed to be guided linearly in the housing module.

Preferably, either the receiving plate or the housing module comprises a linear slot arranged in a transverse direction, and the other of the mentioned parts, i.e. the housing module or receiving plate, comprises a cylindrical pin, such that the cylindrical pin is guided in the linear slot in order to guide the positioning guide linearly in the housing module.

Preferably, the positioning guide device comprises a base plate, the housing module being fastened on the base plate, the receiving plate of the positioning guide being arranged between the base plate and the housing module. The positioning guide can thus be accommodated in a two-part structure that can be rigidly fastened to a forming die, comprising a base plate, which can be fastened directly to the forming die, and a housing module, which can be fastened directly to the base plate and thus indirectly to a forming die.

The positioning guide device preferably comprises a sensor. which is configured to sense the positioning of a blank, and which is connected or connectable to a set of control electronics in order to enable a forming process. The sensor may be, in particular an inductive sensor or a reed contact.

A forming die may comprise, according to the invention, at least one positioning guide device, for positioning of blanks, which is realized as described above.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DESCRIPTION OF THE INVENTION

Figure 2:
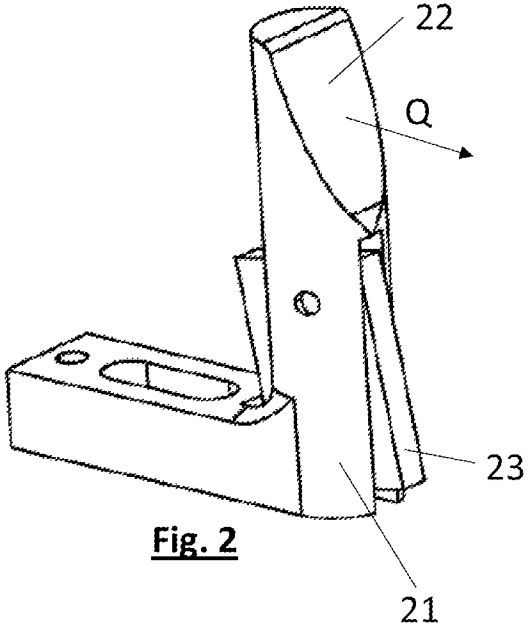
FIG. 2 is a perspective view of another conventional positioning guide.
Figure 1:
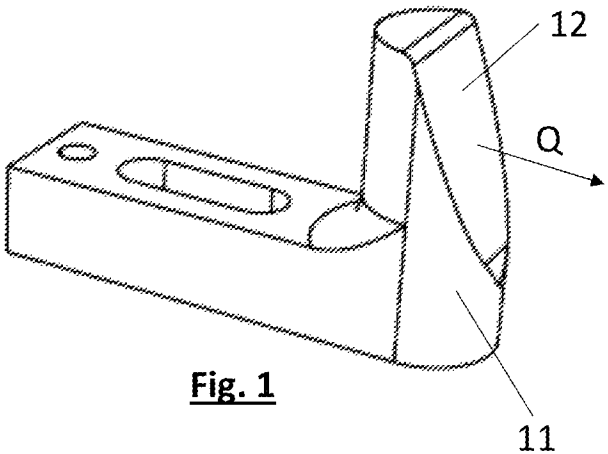
FIG. 1 is a perspective view of a conventional positioning guide.
Figure 4:
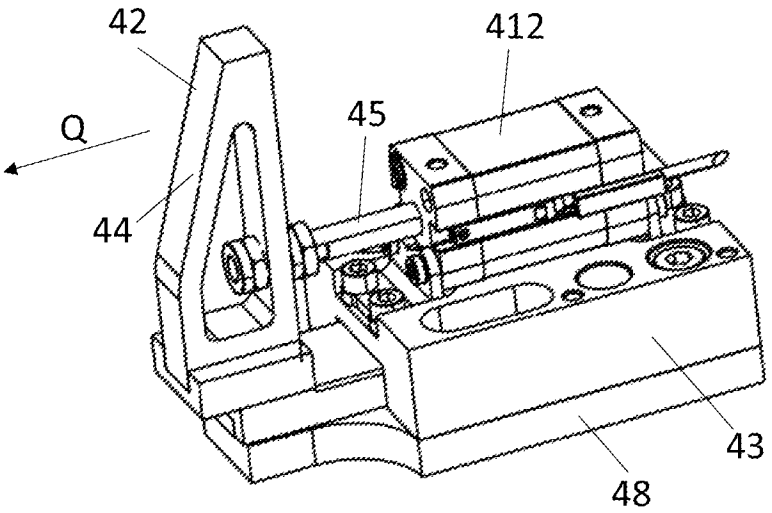
FIG. 4 is a perspective view of a positioning guide device according to the invention and which includes a housing module having a pneumatically-operated cylinder.
Figure 3:
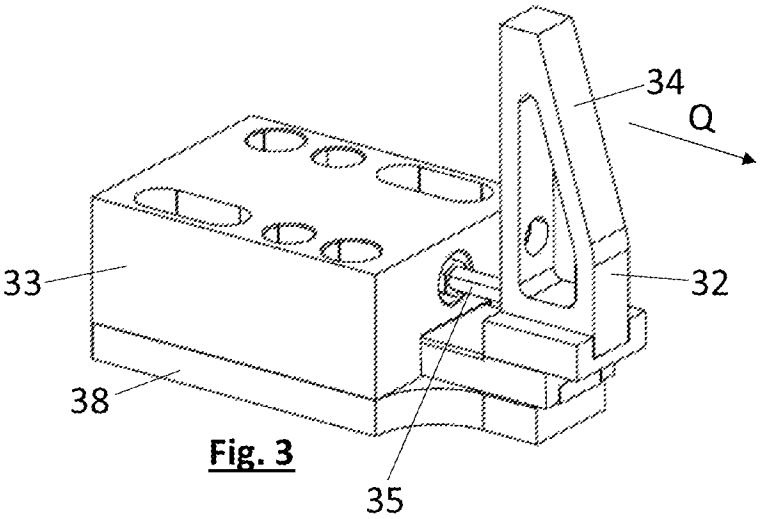
FIG. 3 is a perspective view of a positioning guide device according to the invention and which includes a housing module having a spring-action pressure piece.
Figure 5:
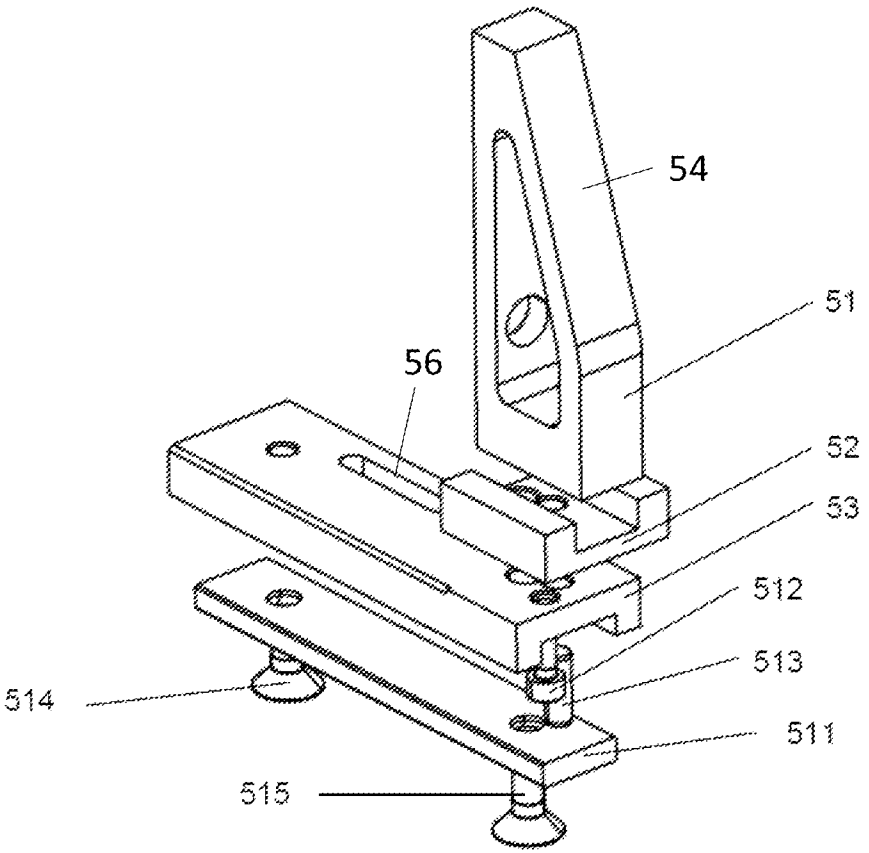
FIG. 5 is a perspective exploded illustration of a positioning guide of a positioning guide device according to the invention.
Figure 6:
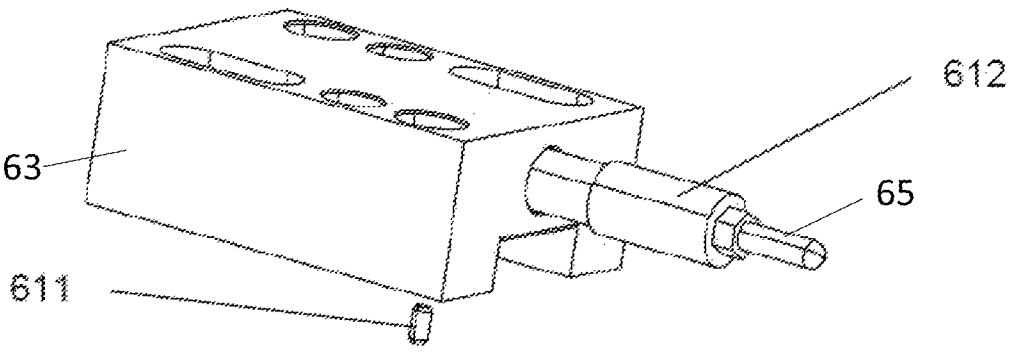
FIG. 6 is a perspective exploded view of a housing module associated with the positioning guide device according to FIG. 3.
Figure 7:
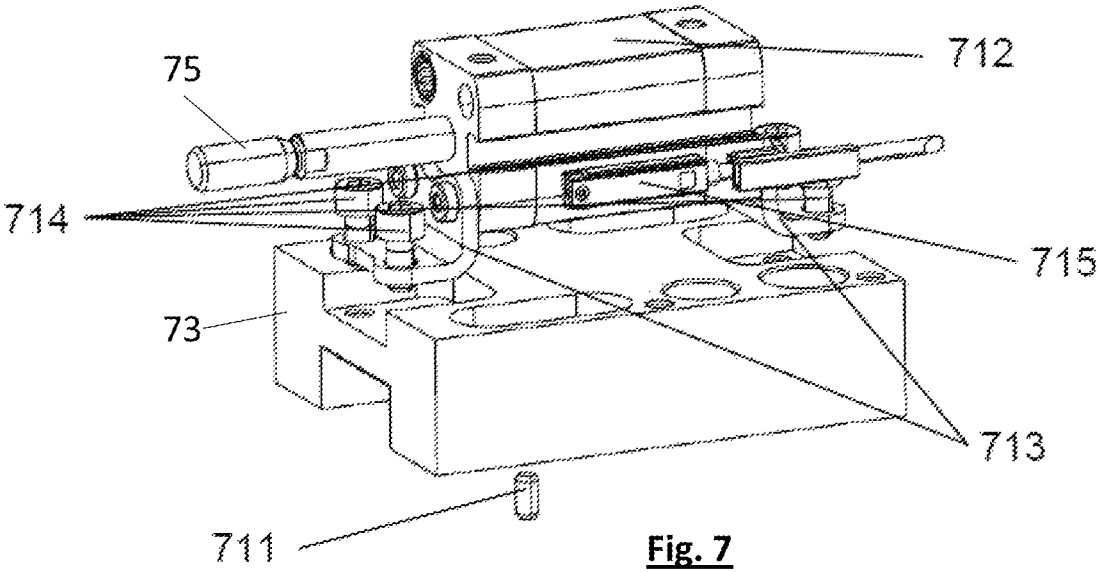
FIG. 7 is a perspective exploded view of a housing module associated with the positioning guide device according to FIG. 4.
Figure 9:
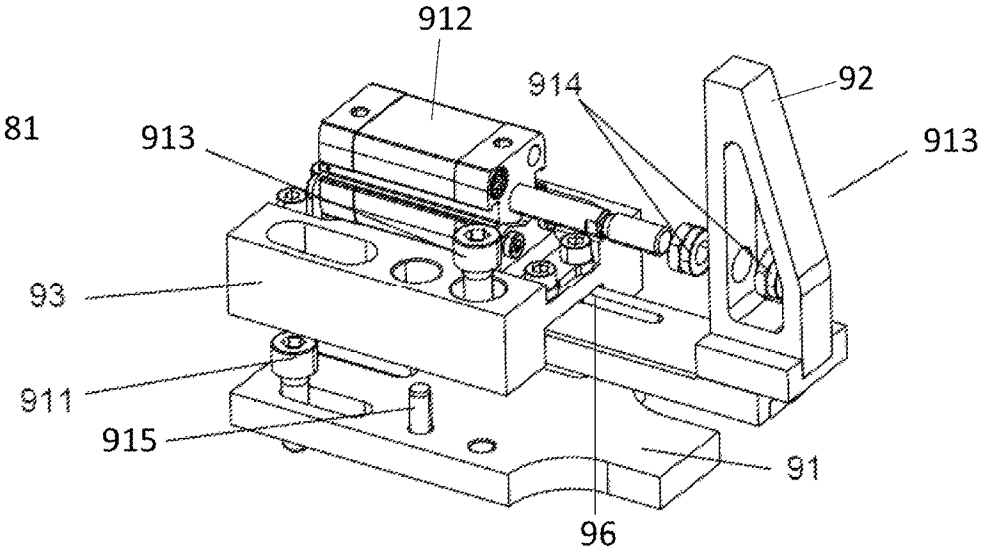
FIG. 9 is a perspective exploded view of a positioning guide device according to FIG. 4.
Figure 8:
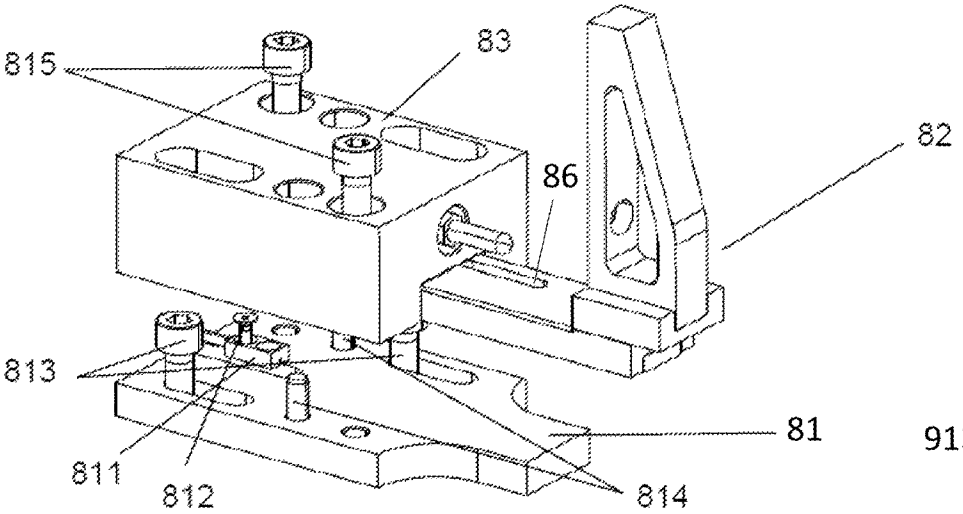
FIG. 8 is a perspective exploded view of a positioning guide device according to FIG. 3.

FIG. 1 and FIG. 2 show a conventional positioning guide device, or conventional positioning guide 11 or 21, not in accordance with the invention. The positioning guides 11, 21 of FIG. 1 and FIG. 2 have a sloped positioning face 12, 22, the positioning face 12, 22 being designed so that a peripheral edge of a blank can be positioned in a transverse direction Q by contact with the positioning face 12, 22, i.e. a blank placed on a positioning guide 11, 21 from above slides along the positioning face 12, 22 during lowering and is thereby displaced in the transverse direction Q in order to position the blank in the transverse direction Q in the desired manner. The conventional positioning guides 11, 21 are rigidly connected to a forming die and may have, for example, a rocker 23 as represented in FIG. 2.

One or more embodiments of a positioning guide devices according to the invention or their components are represented in greater detail with reference to FIG. 3 to FIG. 9.

A positioning guide device according to the invention comprises a housing module 33, 43, 63, 73, 83, 93. The positioning guide 32, 42, 82, 92 is mounted in the housing module 33, 43, 63, 73, 83, 93 as to be linearly displaceable in the transverse direction Q. The housing module 33, 43, 63, 73, 83, 93 has a spring system, for example a spring-loaded pressure piece 612 or a pneumatic cylinder 412, 712, 912, the spring system preloading the positioning guide 32, 42, 82, 92 in the transverse direction Q.

In the following, reference is first made to the embodiments of FIG. 3, FIG. 5, FIG. 6 and FIG. 8. Accordingly, a positioning guide device according to the present invention has a spring-action pressure piece 612, a base plate 38, 81, which is rigidly connected and pinned to the die, a positioning guide 32, 82 which, composed of the positioning guide bracket 51, an intermediate block 52, a receiving plate 53 and a sliding element 511, is mounted so as to be slidable between the base plate 38, 81 and the housing module 33, 63, 83 by means of a spring-action pressure piece 612. At the same time it is secured in its guide via a cylindrical pin 611, which engages in a slot 56, 86 of the receiving plate 53. If a blank is inserted into the drawing die, this causes the positioning guide 32, 82 to slide back, which minimises the friction between the positioning guide 32, 82 and the blank 90, and thereby counteracts the resulting abrasion. At the same time, the positioning guide 32, 82 uses the resultant spring pressure force to press the blank into a predefined position force. The spring pressure force may be adapted to the respective product, or die.

The deep-drawing process is enabled, via a partial position control, by an inductive sensor 811 that may optionally be fitted in the base plate 38, 81. Once this process is completed, the positioning guide 32, 82 slides back into its initial position as a result of the spring pressure force. Since the width of the drawing edge also changes in the event of defects in the deep-drawing process, such as cracks, unevenness, trailing edges and sink marks, the invention presented here also allows this to be monitored in a specific manner in the subsequent production process, and allows defective parts to be removed from the system at an early stage, instead of only at the end of a production line. For example, in this case an excessively wide drawing edge triggers the die safety device and thereby prevents the further production of parts that are defective.

In the following, reference is made in particular to the embodiment of the drawings FIG. 4, FIG. 5, FIG. 7 and FIG. 9. In the design of this invention present here, a positioning guide device has a pneumatically operated cylinder 412, 712, 912, a base plate 48, 91, which is rigidly connected and pinned to the die, a positioning guide 42, 92 which, composed of the positioning guide bracket 51, an intermediate block 52, a receiving plate 53 and a sliding element 511, is mounted so as to be slidable between the base plate 48, 91 and the housing module 43, 73, 93 by means of a pneumatically operated cylinder 412, 712, 912, and is rigidly connected by means of two self-locking nuts 914 to the thread of the piston rod, or plunger 45, 75. At the same time, the positioning guide 42, 92 is secured in its guide via a cylindrical pin 711 that engages in a slot 56, 96 of the receiving plate 53.

When the blank is inserted into the drawing die the positioning guide 42, 92 is in its initial position, i.e. retracted. Shortly thereafter it is pushed into the working position (extended) by means of the cylinder 412, 712, 912, which is actuated by compressed air, this exerting a corresponding pressure force upon the blank, via the positioning guide 42, 92, and pressing it into a predefined position. Via a reed contact 715 that may optionally be fitted on the pneumatically operated cylinder 412, 712, 912, the adjusted end position of the blank can be queried, and the deep-drawing process can be enabled via the partial position control.

A positioning guide device according to the invention may be provided in a modular design and comprise the following: a base plate 38, 48, 81, 91 which is rigidly connected and pinned to the forming die, and which may be equipped with an inductive sensor 811, a receiving plate 53 which, in combination with a sliding element 511, enables the positioning guide 32, 42, 82, 92 to be guided linearly, a positioning guide 32, 42, 82, 92 which, composed of a positioning guide bracket 51 and an intermediate block 52, is rigidly connected to a receiving plate 53 and serves as a stop face for the blank, or the component, and for positioning, a housing module 33, 43, 63, 73, 83, 93, optionally equipped with a spring-loaded pressure piece 612 or a pneumatically operated cylinder 412, 712, 912 to press the blank, or the component, with the positioning guide 32, 42, 82, 92 into a predefined position, and at the same time also to enable guiding of the receiving plate 53, and to secure the positioning guide 32, 42, 82, 92 in its guide by a cylindrical pin 611, 711, which engages in a slot 56, 86, 96 of the receiving plate 53.

The advantage of this invention is that defective components from the deep-drawing process can be reduced, and faulty parts can be removed from the system at an early stage in the subsequent production process.

The advantages include, in detail: in the deep-drawing process, the blanks are pressed by the positioning guide device to a predefined position in order to compensate any deviations in the length or width of the blanks (up to 20 mm, for example). Thus, resulting drawing cracks, sink marks, unevenness and trailing edges can be reduced to a large extent. Due to the receding action of the positioning guide system, abrasion on the positioning guides or chip formation caused by the incorrect position of the blank can be reduced, resulting in fewer reworked parts. In the subsequent production process, the present invention can be used to identify defective parts—by specific monitoring of the drawing edge—at an early stage, and to remove them from the production process. This circumstance results in a further reduction of reworking and scrap costs, as well as the workload and the costs for checking certain problem areas of the component, subsequent sorting and customer claims.

Further advantages are: due to the modular design in this case, defective components can be replaced relatively easily and quickly, and the various modules for the spring pressure piece and pneumatically operated cylinder can be inserted. Moreover, the lightweight construction of the positioning guide favours buckling to the rear, with the result that, in the event of a collision during the production process, there is no damage to the die.

A positioning guide device having a spring-action pressure piece may, according to the invention, comprise (see FIG. 8): a base plate 81, on which an inductive sensor 811 may optionally be fitted in a slot, provided for this purpose, by means of a screw 812, and which is rigidly connected to the die by means of two diagonally offset screws 813 and two diagonally offset cylindrical pins 814; a positioning guide 82, which is rigidly and non-rotatably assembled, by means of a screw 512 and a cylindrical pin 513, from a positioning guide bracket 51, an intermediate block 52 and a receiving plate 53, and which, via a sliding element 511 fastened by means of two screws 514, 515, is additionally secured by means of a screw 515; a housing module 83, in which is fitted a sprung pressure piece 612 that guides the positioning guide 82, mounted so as to be movable in a sliding manner, between the base plate 81 and the housing module 83, secures it in its guide by means of a cylindrical pin 611, and that is rigidly connected to the base plate 81 by means of two diagonally offset screws 815.

A positioning guide device having a pneumatically operated cylinder may, according to invention, comprise (see above, FIG. 9): a base plate 91 that is rigidly connected to the die by means two diagonally offset screws 911 and two diagonally offset cylindrical pins 915; a positioning guide 92, which is rigidly and non-rotatably assembled, by means of a screw 512 and a cylindrical pin 513, from a positioning guide bracket 51, an intermediate block 52 and a receiving plate 53, and which, via a sliding element 511 fastened by means of two screws 514, 515, is additionally secured by means of a screw 515; a housing module 93, on which a pneumatically operated cylinder 712, 912, optionally equipped with a reed contact 715, is mounted by means of two receivers 713, provided for this purpose, and four screws 714, is rigidly connected to the positioning guide 92, via the drill-hole provided for this purpose in the positioning guide bracket 51, by means of the thread on the piston rod, the plunger, of the pneumatically operated cylinder 912 and two self-locking nuts 914, furthermore guides the positioning guide 92, mounted so as to be movable in a sliding manner, between the base plate 91 and the housing module 93, secures it in its guide by means of a cylindrical pin 711, and that is rigidly connected to the base plate 91 by means of two diagonally offset screws 913.

The sprung positioning guide device may comprise housing modules 83, 93 that, depending on the requirement, may be equipped with a sprung pressure piece 612, or with a pneumatically operated cylinder 712. The backward-sliding characteristic of this positioning guide device favours the reduction of abrasion on the positioning guide surfaces, and thus a great reduction of the reworked parts from the deep-drawing process. Since the present invention compensates irregularities in the production process of coils, or blanks (e.g. up to 20 mm), scrap and reworking costs from the deep-drawing process can be greatly reduced, or even eliminated. In order to minimise further costs in respect of scrap, reworking, sorting, labour input, claims and storage, the present invention can be applied in further steps of the production process to specifically monitor critical areas by means of the drawing edge and thus prevent the production of defective parts.

What is claimed is:

1. A positioning guide device, for positioning at least one blank for a forming die, comprising a positioning guide having a sloped positioning face, the positioning face being designed to allow a peripheral edge of the at least one blank to be positioned in a transverse direction by contact with the positioning face, wherein the positioning guide device comprises a housing module, the positioning guide being mounted in the housing module so as to be linearly displaceable in the transverse direction, the housing module having a spring system, the spring system preloading the positioning guide in the transverse direction, wherein the positioning guide further includes a positioning guide bracket and a receiving plate, the positioning guide bracket presenting the positioning face and the receiving plate guided linearly in the housing module, and wherein the housing module is fastened on a base plate with the receiving plate arranged between the base plate and the housing module.

2. The positioning guide device according to claim 1, wherein the spring system comprises a plunger aligned in the transverse direction, the plunger bearing against or being fastened to the positioning guide, a biasing element subjecting the plunger to a predefined force in the transverse direction in order to preload the positioning guide in the transverse direction, such that, when the at least one blank bears against the positioning guide, with a force greater than the predefined force, the plunger is moved linearly opposite the transverse direction.

3. The positioning guide device according to claim 1, wherein the spring system comprises a sprung pressure piece.

4. The positioning guide device according to claim 1, wherein the spring system comprises a pneumatically operated cylinder.

5. The positioning guide device according to claim 1, wherein either the receiving plate or the housing module comprises a linear slot in a transverse direction, and the other of the receiving plate and the housing module comprises a cylindrical pin, and wherein the cylindrical pin is guided in the linear slot.

6. The positioning guide device according to claim 1, wherein the positioning guide device comprises a sensor configured to sense the positioning of the at least one blank and which is connected or connectable to a set of control electronics in order to enable a forming process.

7. A forming die comprising at least one positioning guide device for positioning of blanks, wherein the positioning guide device is realized according to claim 1.

8. A positioning device for positioning blanks for a forming die, comprising:

a base plate for being connected to the forming die;

a housing module coupled to the base plate;

a positioning guide mounted to the housing module and including a receiving plate positioned between the base plate and the housing module and linearly moveable relative to the housing module in a transverse direction, and a positioning guide bracket connected to the receiving plate and presenting a sloped positioning face for contacting a peripheral edge of a blank with the blank positioned in the transverse direction; and the housing module having a spring system preloading the positioning guide in the transverse direction.

9. The positioning device according to claim 8, wherein the spring system includes a plunger extending in the transverse direction in engagement with the positioning guide, wherein a biasing element subjects the plunger to a predefined force in the transverse direction in order to preload the positioning guide in the transverse direction such that when one of the blanks bears against the positioning guide with a force greater than the predefined force, the plunger is moved linearly in a direction opposite the transverse direction.

10. The positioning device according to claim 8, wherein the spring system comprises a sprung pressure piece.

11. The positioning device according to claim 8, wherein the spring system comprises a pneumatically operated cylinder.

12. The positioning device according to claim 8, wherein one of the receiving plate and the housing module defines a linear slot in a transverse direction, and the other of the receiving plate and the housing module includes a cylindrical pin that is guided in the linear slot.

13. The positioning device according to claim 8, further including a sensor configured to sense the position of the blank and which is connected or connectable to a set of control electronics in order to enable a forming process.

* * * * *